United States Patent [19]

Dorleans et al.

[11] Patent Number: 4,900,274

[45] Date of Patent: Feb. 13, 1990

[54] KEYING SYSTEM FOR ASSURING PROPER ARRAY CONFIGURATION OF CABLE CARDS

[75] Inventors: Fernand J. Dorleans, Wappingers Falls, N.Y.; Robert O. Norton, Susquehanna, Pa.; Robert S. Pokrzywa, Endwell, N.Y.

[73] Assignee: International Business Machines Corporation, Armonk, N.Y.

[21] Appl. No.: 284,578

[22] Filed: Dec. 15, 1988

[51] Int. Cl.[4] ..... H01R 9/28

[52] U.S. Cl. ..... 439/680

[58] Field of Search ..... 439/498, 680, 681

[56] References Cited

U.S. PATENT DOCUMENTS

| | | | |
|---|---|---|---|
| 3,177,461 | 4/1965 | Hagan et al. . | |
| 3,376,565 | 3/1983 | Bird et al. | 339/186 |
| 3,611,272 | 10/1971 | Fairbairm et al. | 339/184 |
| 3,714,617 | 1/1973 | Bright et al. | 339/186 |
| 4,032,213 | 6/1977 | Snyder et al. | 339/186 |
| 4,307,927 | 12/1981 | Mollman | 339/186 |
| 4,542,441 | 9/1985 | Peretta | 361/412 |
| 4,577,917 | 3/1986 | Nashimoto et al. | 439/680 |
| 4,726,791 | 2/1988 | Rudy, Jr. et al. | 439/677 |
| 4,758,928 | 7/1988 | Wierec et al. | 439/680 |
| 4,773,881 | 9/1988 | Adams, III | 439/681 |

FOREIGN PATENT DOCUMENTS 0033286 8/1981 European Pat. Off. .

OTHER PUBLICATIONS

IBM Technical Disclosure Bulletin, vol. 32, No. 2, Dtd. Jul. 1988.

*Primary Examiner*—Joseph H. McGlynn
*Attorney, Agent, or Firm*—William N. Hogg

[57] ABSTRACT

A keying system for assuring the proper sequence or arrangement of cable cards within a card grouper is provided. The grouper includes a plurality of slots to receive the cable cards. The cards include tab means at at least one side thereof which can be selectively trimmed to one of several specific extension distances from the card. The grouper includes a template which has grooves configured to receive cards having their tabs programmed to one and only one configuration. Thus any given card, when programmed, will fit in only one location. The cards and grouper also include coacting surfaces to allow the appropriate card to be inserted in only one orientation in any given slot.

9 Claims, 4 Drawing Sheets

KEYING SYSTEM FOR ASSURING PROPER ARRAY CONFIGURATION OF CABLE CARDS

BACKGROUND OF THE INVENTION

This invention relates generally to the grouping of a multiplicity of cable cards in a selected array configuration, and more particularly to a combination of a multiplicity of cable cards and a card grouper which together have a keying system to assure the cards will reside in one and only one array or sequence configuration within the grouper.

In the art of computer technology it is often necessary to provide a multitude of external connections of power lines and signal lines to planar circuit boards. One convenient and conventional technique for accomplishing this is to provide an array of pin connectors, such as Harcon connectors on a printed circuit board. These are connectable to various types of cables, which cables are attached to cable cards having a plurality of connection means extending from one edge thereof. Frequently it is necessary to provide connection to more than one cable with a given array of connectors on the circuit board. This is conventionally accomplished by some type of cable card grouper for arranging and securing the multiplicity of cable cards in array for a given or fixed configuration such that the group of cables can be installed into the connectors on the board as a unit. Conventionally these cable cards have all had the same configuration and care had to be exercised in arranging these cable cards in the card grouper to assure that they were all arranged in the proper order or sequence in the grouper to assure that each cable would make contact with the proper connectors in the array on the circuit board. In the past this arrangement has been left to the functioning of an assembler. This, however, is subject to human error.

There have been a number of prior proposals for keying and polarizing arrangements in various electrical devices. For example, U.S. Pat. No. 4,542,441 discloses a guide and notch assembly with notches of various lengths to connect circuit boards to a base; U.S. Pat. No. 4,376,565 shows a keying arrangement for plug-in electrical connections; and U.S. Pat. No. 4,773,881 shows another arrangement for keying of electrical connection assemblies. In addition to these references U.S. Pat. Nos. 4,307,927; 3,177,461; 3,714,617; 3,611,272; 4,032,213; 4,726,791; and European Patent Application 0 033 286 as well as IBM Technical Disclosure Bulletin Volume 31, No. 2, July 1988, page 141, show various cable configurations and electrical connectors utilizing various keying and polarizing techniques. However, none of these references disclose a technique for keying an array of cable cards in a card grouper in such a way to allow a unique configuration of the cable cards in the array.

SUMMARY OF THE INVENTION

According to the present invention an improved keying system for assuring the proper arrangement of cable cards within a card grouper is provided. Each of the cable cards has a plurality of cables mounted thereon and extending from one end thereof. The other end of the cards each have electrical connection means extending therefrom for connection to electrical connectors. The card grouper includes support means to retain a plurality of said cards in a side by side array with the connection means of said cards being aligned and projecting from one end of the support means. The support means includes first and second sets of a plurality of parallel slots on opposite sides to engage the opposite sides of the cards and retain said cards in said array. Each of the cable cards includes tab means formed at least one side of one end thereof. The tab means are selectable to extend at least two different distances from the respective edges of the card. The grouper includes template means associated therewith and positioned to coact with the tab means of said cards. The template means has a plurality of sets of notches, each set of notches being configured to coact with the tab configuration of one and only one cable card, whereby the cards can be uniquely accepted in one and only one array or sequence in said card grouper.

DESCRIPTION OF THE PREFERRED EMBODIMENT

Figure 1:
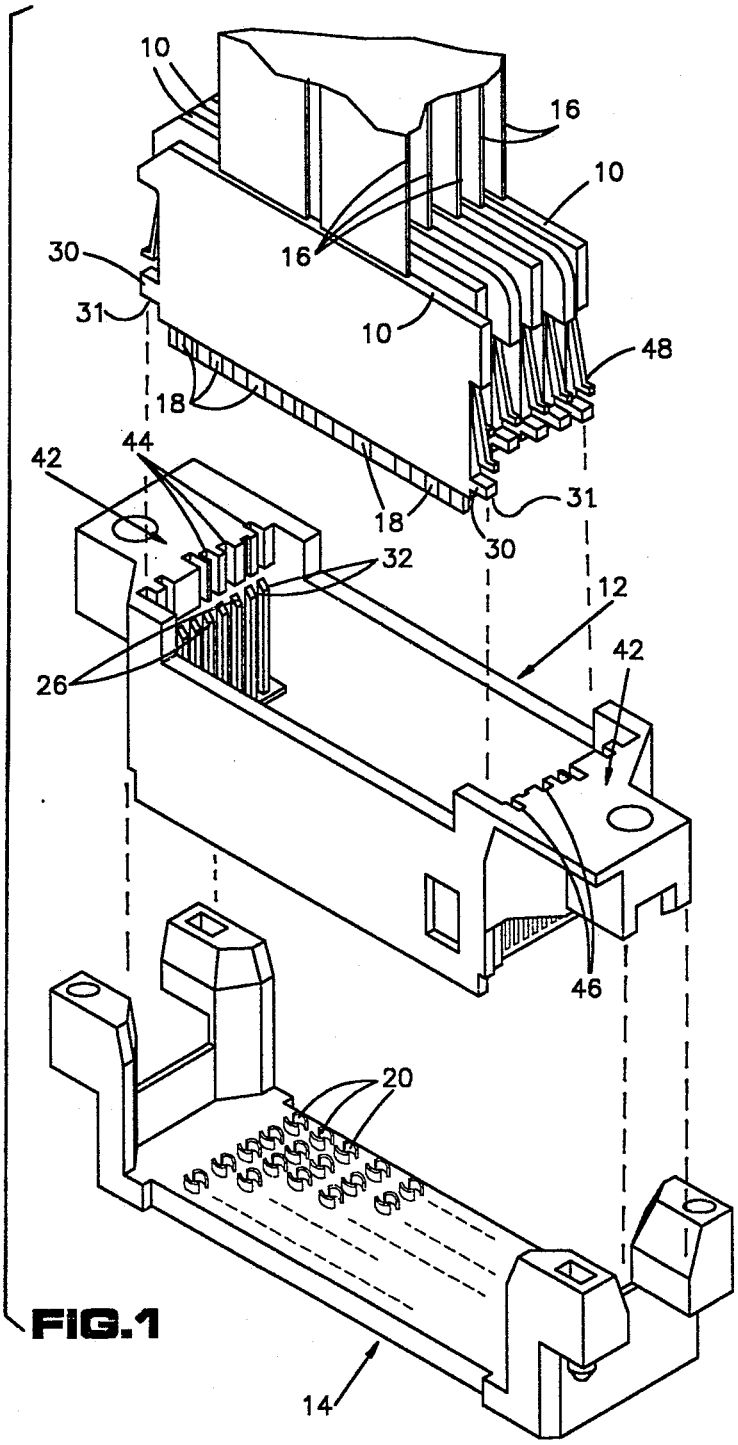
FIG. 1 is an exploded perspective view of one embodiment of this invention showing a plurality of cable cards keyed into a card grouper in which one and only one configuration or sequence of the card array is permitted.

Referring now to the drawing and for the present to FIG. 1, a group of cable cards 10 are shown which are adapted to be arrayed and secured in a card grouper 12 which in turn presents the cable cards as a unit to a connector housing 14. Each of the cable cards 10 is adapted to receive flat cables 16 at one end thereof and provide connection means 18 at the opposite thereon for connection to various types of connectors such as bifurcated spring connectors 20 which are arrayed in the connector housing 14. It is essential that the cable cards 10 with their associated flat cables 16 be properly arrayed in the card grouper 12, i.e., in the proper sequence and also that they be inserted in the proper orientation, i.e., with the proper polarity and not reversed 180°, so that the connection means 18 can engage the proper connector 20 on the housing 14.

Figure 2:
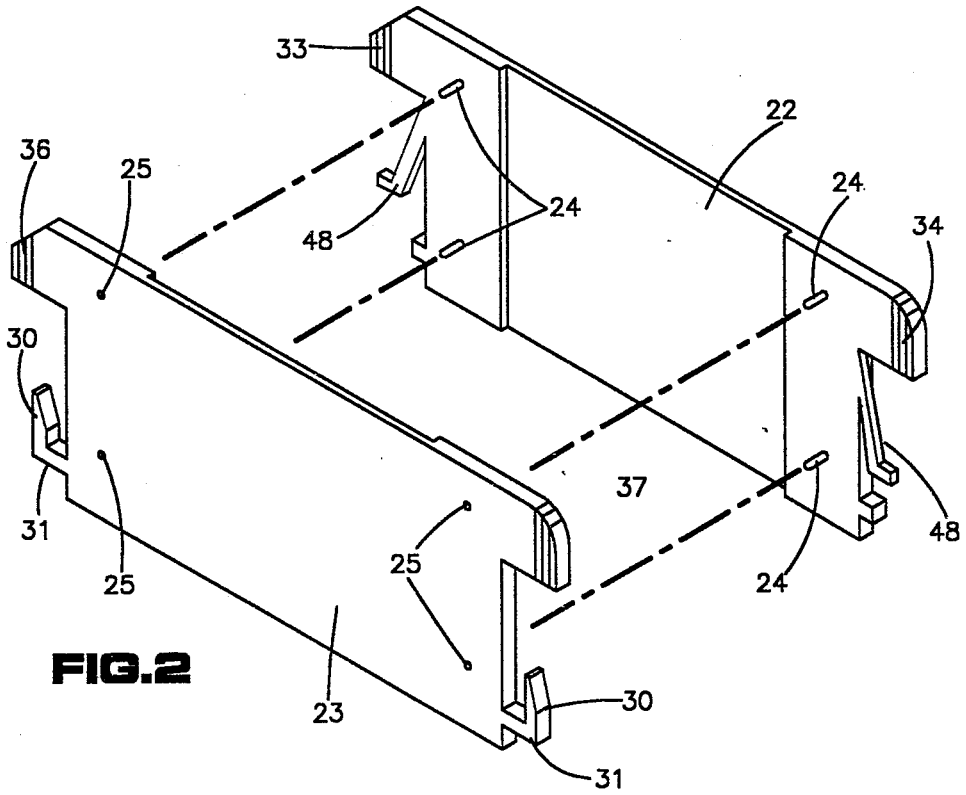
FIG. 2 is an exploded perspective view of a cable card utilized in this invention.

As shown in FIG. 2, each of the cable cards 10 is comprised of a pair of flat plate members 22 and 23 adapted to receive between them the flat cables. The plates 22 and 23 are secured together such as by adhesives or by ultrasonic or fusion bonding. Also, if desired, guide pins 24 are provided on the plate member 22 with mating apertures 25 provided in the plate member 23 so as to precisely align the two plates 22 and 23 to form a cable card unit.

Figure 3:
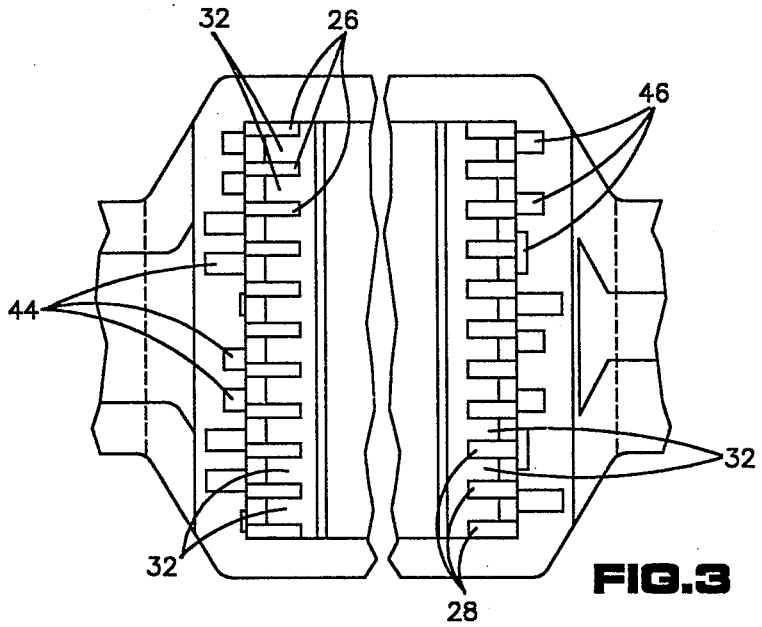
FIG. 3 is a plan view of the card grouper.

As seen in FIGS. 1 and 3, the card grouper 12 is provided with a first set of parallel slots 26 extending down one side thereof and a second set of parallel slots 28 extending down the other side thereof. The slots 26 and 28 are arranged to receive slide members 30 formed on opposite sides of plate 23. The bottom side of the slide members 30 have a shoulder 31. The shoulder 31 acts as a polarizing device which will allow the cards to be inserted only in one orientation since if they are reversed the shoulder 31 will not fit into the respective slots 26 and 28 but will abut the surfaces 32 adjacent thereto.

The plate 22 is provided with a pair of tabs 33 and 34 on opposite sides thereof and the plate 23 is provided with tabs 36 and 37 on opposite sides thereof. Each of the tabs are scored at four different positions so that they may be broken or cut off in increments to provide three separate extension distances from each side of their respective plates. Each of the tabs can be trimmed or programmed to the appropriate one of four lengths to provide the keying function wherein each separate cable card may be uniquely configured vis-a-vis the configuration of its four tabs so as to fit only into a given preselected position within the card grouper 12 as will be presently described.

Figure 4A:
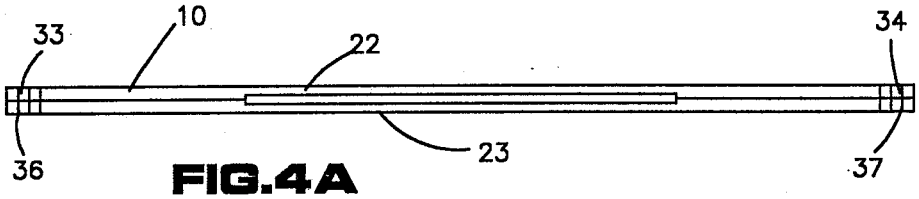
FIGS. 4A through 4C are plan views of cable cards in various programmed conditions.
Figure 4B:
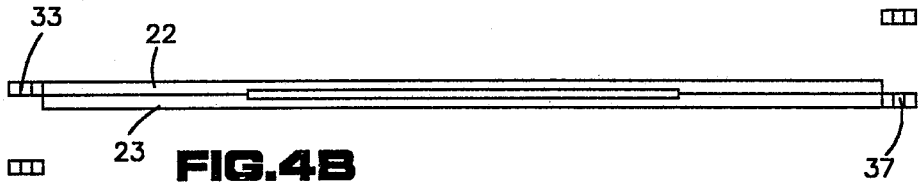
Figure 4C:
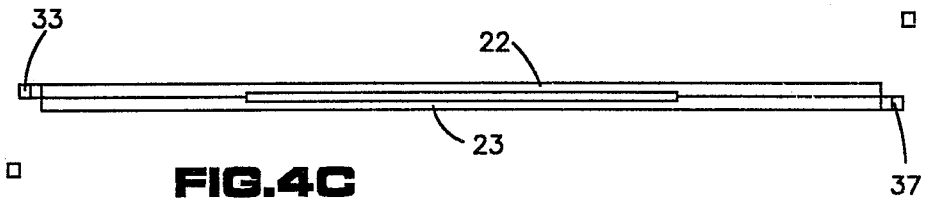

However, before describing the interaction between the card grouper 12 and the cable cards 10, reference is directed to FIGS. 4A, 4B, and 4C, wherein a cable card is shown in various stages of being programmed or configured to a specific and unique configuration. In FIG. 4A the cable card is shown with all four tabs in their initial state and unprogrammed. In FIG. 4B the tabs 34 and 36 have been removed from the opposite ends of side plates 22 and 23 respectively. Then in FIG. 4C only the very end portion of tabs 33 and 37 have been removed. Each of the cards is programmed in a similar manner, however, to a different configuration so that each will uniquely fit into one and only one location of the card grouper 12.

Figure 7:
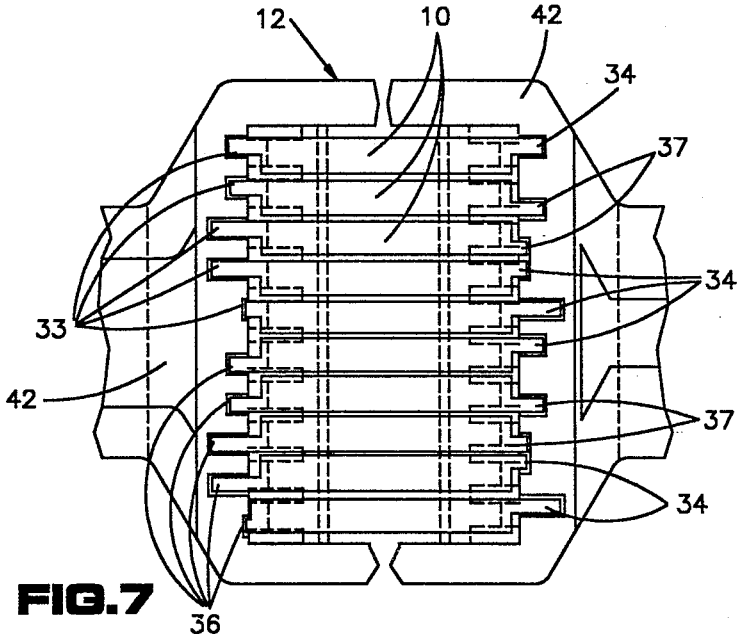
FIG. 7 is a top plan view partially in section showing an array of cable cards inserted into a card grouper.
Figure 5:
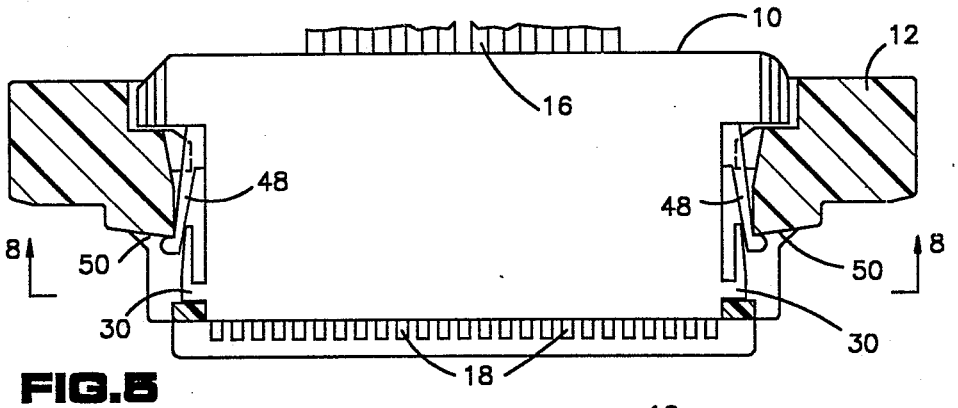
FIG. 5 is a longitudinal sectional view of a card inserted into its proper position in the card grouper.
Figure 8:
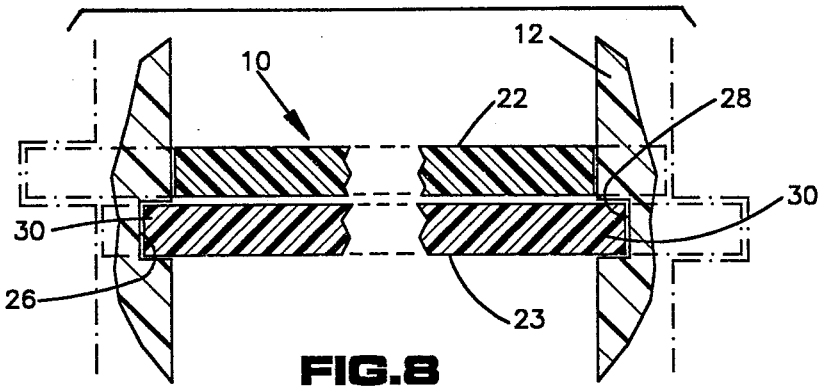
FIG. 8 is a sectional view taken substantially along the plane designated by line 8—8 in FIG. 5.

As shown in FIGS. 1 and 3, the card grouper includes a template portion 42 which has a series of ten locations for the reception of various cable cards 10. The template portion 42 may be molded into the top position of the card grouper as shown herein, or it may be formed as a separate sheet and attached to the top of the grouper. The template 42 at each location is provided with a pair of notches 44 and 46 on opposite sides thereof. Each of the notches 44 and 46 is sized and arranged such that it will receive only one programmed configuration of a programmed cable card. As can be seen in FIGS. 5, 7 and 8 a properly programmed or trimmed cable card 10 fits into the slots and the notches to provide one and only one array, i.e. a unique sequence of the cards 10 within the grouper 12 as determined by the programming of the cards and the template of the grouper.

Figure 6:
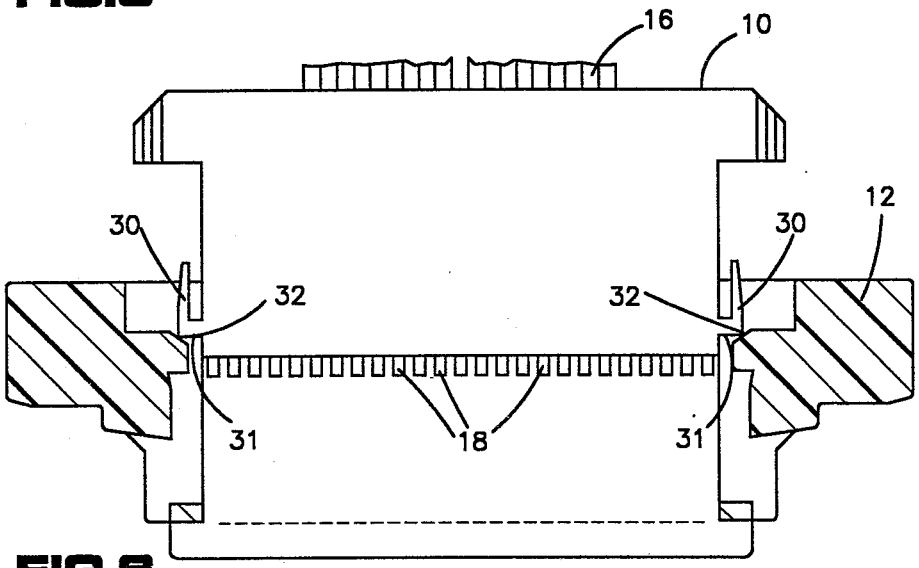
FIG. 6 is a longitudinal sectional view similar to FIG. 5 showing a cable card being prevented from insertion at a improper orientation.

FIG. 6 depicts the situation where it is attempted to insert the cable card into a slot improperly oriented; i.e. reversed 180°. In this case the card cannot be inserted irrespective of the tab programming because the shoulder 31 abuts a surface 32 adjacent its groove.

To complete the structure of the card, each plate 23 is provided with a resilient arm 48 which serves as a latch to latch against the undersurface 50 of the card grouper and prevent unintended withdrawal of each of the cards.

FIG. 7 shows a group of ten different cable cards inserted into a card grouper 12 wherein the card grouper has each of the ten locations uniquely configured to receive only the properly programmed and properly oriented cable card 10.

Although the preferred embodiment utilizes a flat cable, other types of cable, e.g. twisted pair, tri-lead, etc. may be effectively utilized.

While one embodiment of the invention has been shown and described in detail, various adaptations and modifications can be made without departing from the scope of the invention as defined in the appended claims.

What is claimed is:

1. A keying system for providing the proper array sequence of cable cards within a card grouper, and wherein each of said cable cards has a plurality of cables mounted thereon and extending from one end thereof and the other end of the card has electrical connection means extending therefrom, and wherein said card grouper includes support means to retain a plurality of said cards in a side by side array with the connection means of said cards being aligned and projecting from one end of said support means, and wherein said support means includes first and second sets of a plurality of parallel slots on opposite sides thereof to engage the opposite ends of said cards and retain said cards in said array;

the improvement which comprises;

tab means formed at one end of each of said cards on at least one edge thereof, said tab mean being selectable to extend to at least two different distances from the respective edge of the card, said card grouper including template means associated therewith and positioned to coact with the tab means of said cards, said template means having a plurality of sets of notches, each set of notches being configured to coact with the tab configuration of one and only one cable card;

whereby the cards can be uniquely arrayed in one and only one pattern in said card grouper.

2. The invention as defined in claim 1 wherein said tab means on each card includes at least one tab extending from each side of said card.

3. The invention as defined in claim 2 wherein each card includes a pair of plates juxtaposed in face to face relationship with the cable disposed therebetween, and wherein each of said plates has a tab which is individually selected to extend to the desired distance, whereby two tab configurations can be independently provided on each side of the card.

4. The invention as defined in claim 1 further characterized by polarizing means to allow the card to be inserted into its respective slot in one orientation only.

5. The invention as defined in claim 4 wherein said polarizing means include stop means formed on said support means, and shoulder means formed on said card grouper and positioned to coact with said stop means to prevent the card from being inserted in the wrong orientation.

6. The invention as defined in claim 2 wherein said tabs are all initially formed of uniform length, and means are provided to selectively shorten the length of each tab individually.

7. The invention as defined in claim 3 wherein said tabs are all initially formed of uniform length, and means are provided to selectively shorten the length of each tab.

8. The invention as defined in claim 2 wherein means are provided to selectively shorten the tabs to at least two selected shorter lengths.

9. The invention as defined in claim 3 wherein means are provided to selectively shorten the tabs be at least two selected shorter lengths.

* * * * *